US006843402B2

(12) United States Patent
Sims et al.

(10) Patent No.: US 6,843,402 B2
(45) Date of Patent: Jan. 18, 2005

(54) ADJUSTABLE TOOL MOUNT

(75) Inventors: Kelso G. Sims, Crystal Lake, IL (US); Kenneth Kazmierski, Wonder Lake, IL (US)

(73) Assignee: Peace Industries, Ltd., Rolling Meadows, IL (US)

( * ) Notice: Subject to any disclaimer, the term of this patent is extended or adjusted under 35 U.S.C. 154(b) by 0 days.

(21) Appl. No.: 09/922,347

(22) Filed: Aug. 3, 2001

(65) Prior Publication Data

US 2003/0024962 A1 Feb. 6, 2003

(51) Int. Cl.[7] ..... B25C 07/00
(52) U.S. Cl. ..... 227/148; 227/140; 227/119
(58) Field of Search ..... 227/148, 140, 227/119, 110, 111, 151, 159, 143; 173/90; 83/745

(56) References Cited

U.S. PATENT DOCUMENTS

| | | | | | |
|---|---|---|---|---|---|
| 2,915,754 | A | | 12/1959 | Wandel | |
| 3,012,247 | A | | 12/1961 | Sillars et al. | |
| 3,112,488 | A | * | 12/1963 | Dettloff et al. | 227/127 |
| 3,281,046 | A | * | 10/1966 | Boulay | 227/115 |
| 3,360,176 | A | | 12/1967 | Gehl et al. | |
| 3,670,941 | A | | 6/1972 | Grinnell et al. | |
| 3,864,053 | A | * | 2/1975 | Harwood | 408/110 |
| 4,239,195 | A | * | 12/1980 | Oltman et al. | 269/16 |
| 4,332,203 | A | | 6/1982 | Flowers | |
| 4,415,149 | A | * | 11/1983 | Rees | 269/88 |
| 4,502,457 | A | * | 3/1985 | Marron | 125/11.14 |
| 4,523,706 | A | | 6/1985 | Haley | |
| 4,603,479 | A | * | 8/1986 | Bergler | 30/475 |
| 4,822,014 | A | * | 4/1989 | Buchler | 269/71 |
| 5,028,179 | A | * | 7/1991 | Grasset | 409/180 |
| 5,054,678 | A | | 10/1991 | Nasiatka | |
| 5,110,027 | A | * | 5/1992 | Burlingame | 227/8 |
| 5,125,552 | A | * | 6/1992 | Medwed | 227/156 |
| 5,141,211 | A | * | 8/1992 | Adams, Jr. | 269/16 |
| 5,205,198 | A | * | 4/1993 | Foray et al. | 83/435.12 |
| 5,251,371 | A | | 10/1993 | Powers | |
| 5,280,892 | A | * | 1/1994 | Smith | 269/75 |
| 5,628,445 | A | | 5/1997 | Braddock et al. | |
| 5,738,473 | A | | 4/1998 | Tebo | |
| 5,743,455 | A | | 4/1998 | Holliday | |
| 5,758,998 | A | * | 6/1998 | White | 409/180 |
| 5,868,183 | A | * | 2/1999 | Kozyrski et al. | 144/136.1 |
| 5,884,681 | A | * | 3/1999 | Nickles | 144/329 |
| 5,918,790 | A | | 7/1999 | Donnell | |
| 6,050,470 | A | * | 4/2000 | Feesenmayr et al. | 227/78 |
| 6,161,744 | A | | 12/2000 | Mukoyama et al. | |
| 6,269,996 | B1 | * | 8/2001 | McAllister | 227/7 |
| 6,318,620 | B1 | * | 11/2001 | Anstett et al. | 227/147 |
| 6,378,197 | B1 | * | 4/2002 | Hansen | 29/823 |
| 6,442,830 | B1 | * | 9/2002 | Vrana | 29/715 |

* cited by examiner

*Primary Examiner*—Scott A. Smith
*Assistant Examiner*—Brian D Nash
(74) *Attorney, Agent, or Firm*—Wood, Phillips, Katz, Clark & Mortimer

(57) ABSTRACT

A tool mount for a pneumatic tool used in installing tongue and groove flooring or other strip material. The mount has a base with a vertically adjustable tool carrier and an adjustable spacer to position the tool vertically and laterally with respect to the flooring or other strip material.

11 Claims, 2 Drawing Sheets

ADJUSTABLE TOOL MOUNT

This invention relates to a mount particularly for a fastening tool, as a pneumatic nailer or stapler, used in the installation of strip material, as tongue and groove flooring or the like.

BACKGROUND OF THE INVENTION

Tongue-and-groove flooring is typically installed with a pneumatic nailer or stapler which drives a fastener at an angle, as 45 degrees, through the edge of a flooring strip from a point above the tongue and into the subfloor. The pneumatic tool is positioned to drive the fastener with an adapter which rests on the subfloor and locates the nose of the tool at the desired height and angle. However, tongue and groove flooring is available in various thicknesses and with various tongue configurations. Each different style of flooring requires a different adapter.

BRIEF SUMMARY OF THE INVENTION

A principal feature of the invention is a tool mount which is adjustable to position a tool properly for driving a fastener in different styles of tongue and groove flooring or the like. The mount may be used in other environments where a tool requires positioning in vertical or lateral dimensions with respect to a work-piece.

More particularly, the tool mount comprises a base, a tool carrier having a surface for receiving a tool and adjustable vertically on the base to position the tool vertically with respect to the work piece, and a spacer on the base to position the tool laterally with respect to the work piece. A further feature of the tool mount is that the spacer is adjustable laterally on the base.

Another feature of the tool mount is that the base comprises a center plate supported by a pair of side plates and the tool carrier slides on the center plate with a vertical component of movement.

A further feature of the tool mount is that the tool carrier has a lateral component of movement and the spacer is adjustable laterally on the base.

And another feature of the tool mount for a tool which fastens tongue and groove flooring to a subfloor is that the base of the tool mount rests on the subfloor with the spacer engaging the face of a strip of flooring and the tool mount has a handle for an operator to move the tool mount and the tool across the subfloor, along the length of the strip of tongue and groove flooring.

DETAILED DESCRIPTION OF THE INVENTION

Figure 1:
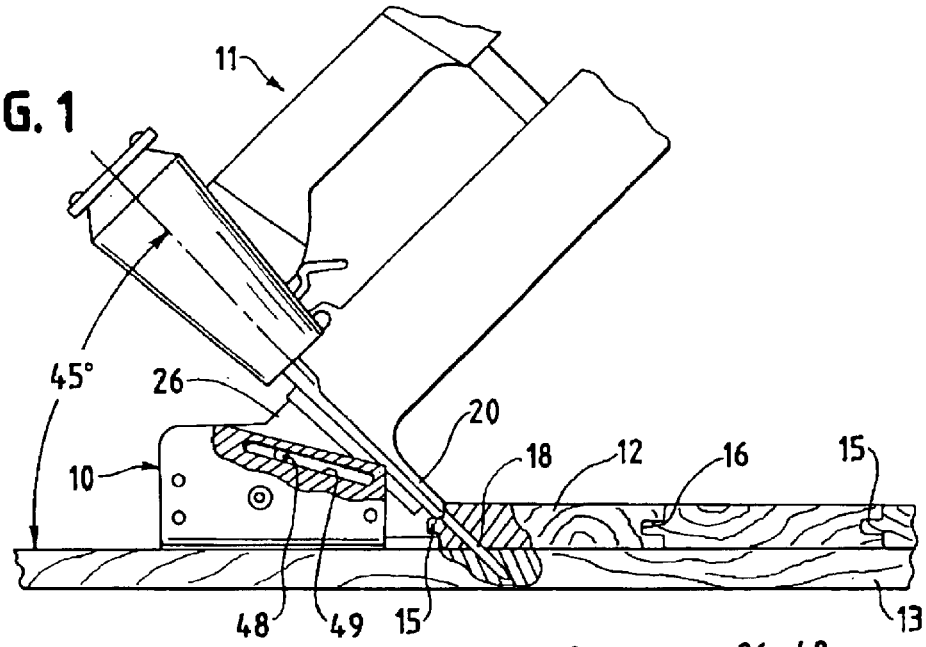
FIG. 1 is a side view of the tool mount with a portion broken away and a tool for driving fasteners into tongue and groove flooring on the tool carrier.

The tool mount is shown in the drawings with and is particularly adapted for a tool which drives fasteners to install tongue and groove flooring. The mount may be used with tools for driving fasteners in other strip material as a molding for holding a door panel or a window pane, for example.

Tool mount 10, FIG. 1, carries a tool 11, as a pneumatic staple driver, for the installation of tongue and groove flooring 12 on a subfloor 13. Each strip of tongue and groove flooring has a tongue 15 along one edge and a groove 16 along the other edge. The flooring is installed with a groove receiving the tongue of the adjoining strip. Tongue and groove flooring is secured to the subfloor with a fastener 18, e.g., a staple or nail, driven at an angle of the order of 45 degrees through the edge of the flooring strip from a point above tongue 15 into subfloor 13. The fasteners are typically driven with a pneumatic tool 11 which has a nose 20 with a guide through which the fastener is directed into the flooring strip and the subfloor.

Commercial flooring has various thicknesses, typically from ⅜" to ¾" and the tongue may have different dimensions and spacing from the bottom surface of the strip. Accordingly, the height above the subfloor of the point at which the fastener is directed into the edge of the strip of flooring may vary from job to job. As will appear, tool mount 10 provides for adjustment of the position of the tool to accommodate the flooring with which it is used.

Figure 2:
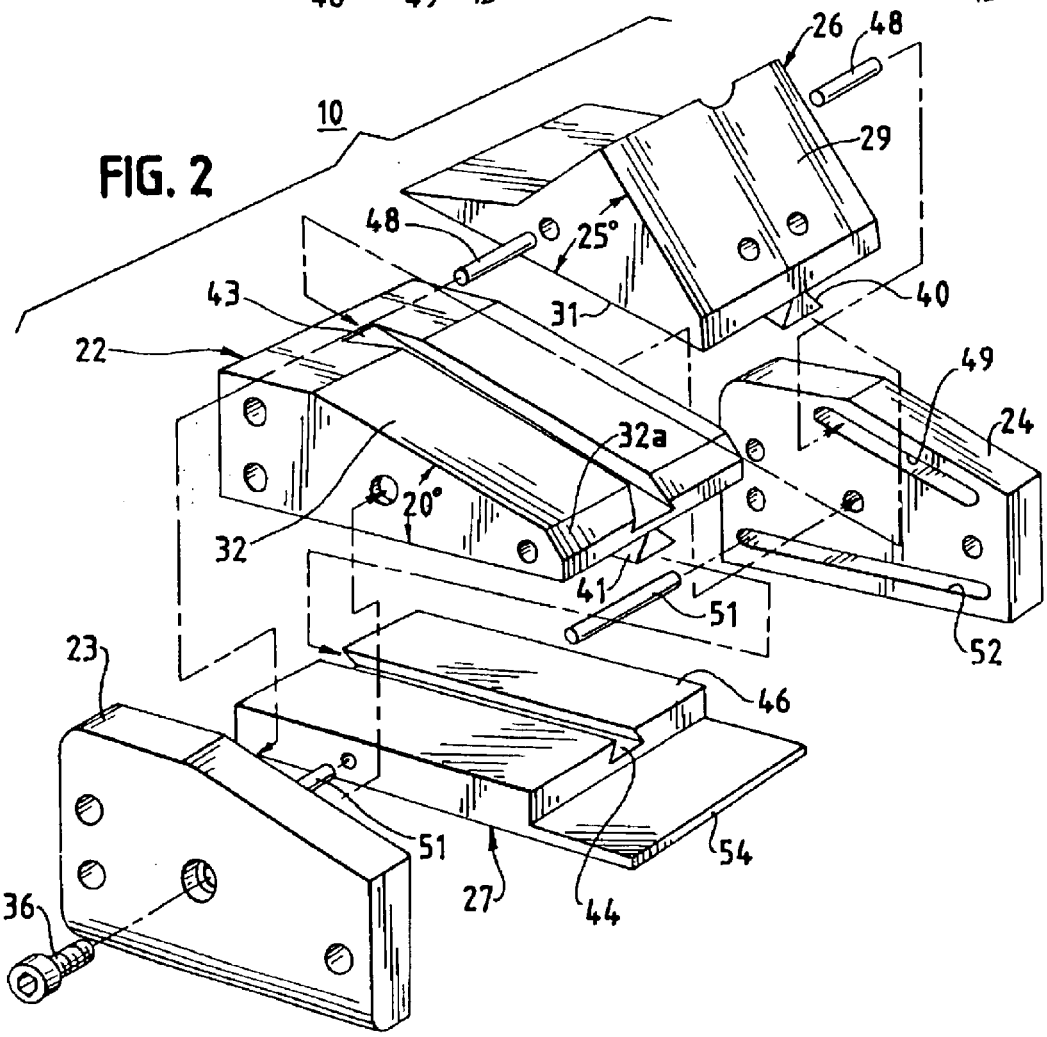
FIG. 2 is an exploded perspective view of the tool mount.
Figure 3:
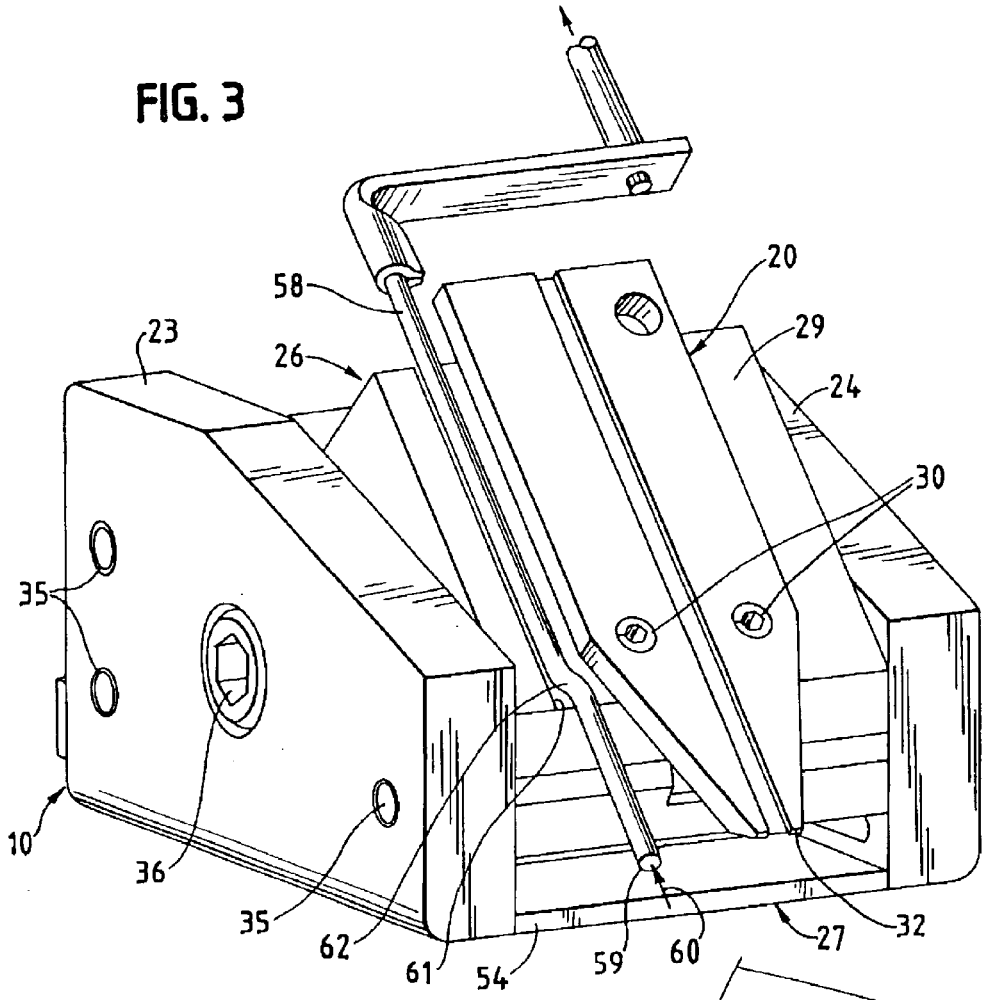
FIG. 3 is a perspective view of the tool mount showing the nose of a tool and the tool safety actuator.
Figure 4:
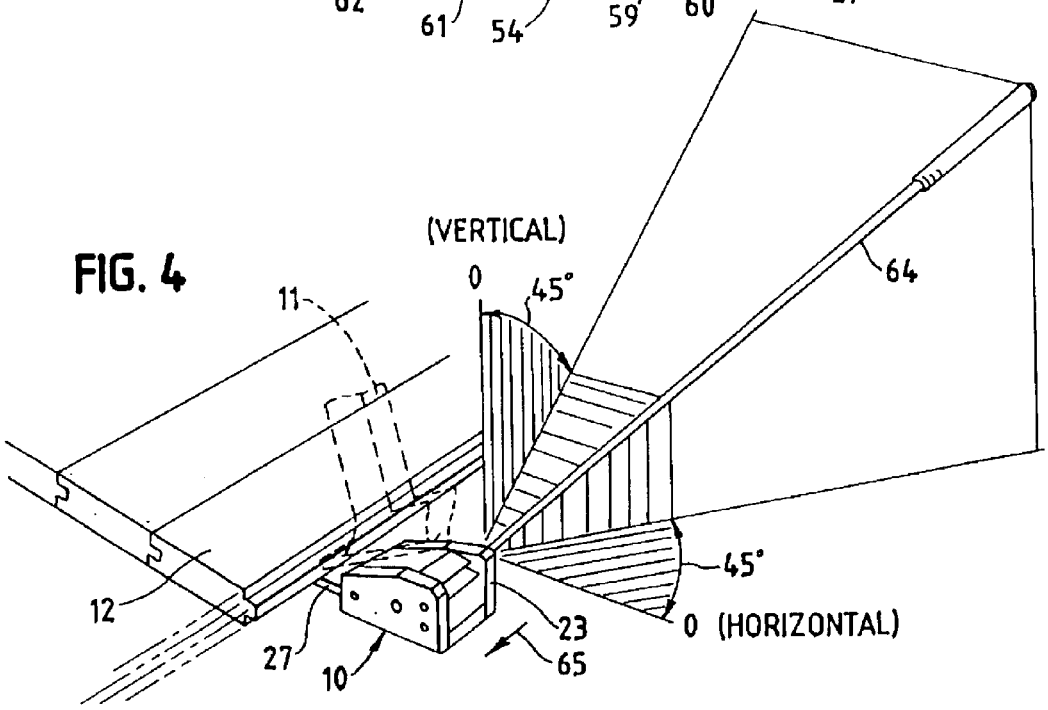
FIG. 4 is a perspective view of the tool mount fitted with a handle and a portion of a tool shown in dashed lines.

The tool mount 10 comprises center plate 22 with side plates 23, 24 which together form a base for adjustable tool carrier 26 and adjustable lateral spacer 27, FIG. 2. Nose 20 of tool 11 is secured to the upper surface 29 of tool carrier 26 by screws 30, FIG. 3.

Center plate 22 and side plates 23, 24 are aligned by dowel pins 35 and are secured together by bolt 36 which extends from side plate 23 through center plate 22 and is threaded into side plate 24. The upper surface 32 of center plate 22 has an angle of the order of 20 degrees with the horizontal. Tool carrier 26 is slidable on the surface 32, adjusting the height of the tool carrier and thus the height of the end 33 of tool nose 20 through which fastener 18 is discharged. The upper surface 29 of tool carrier 26 has an angle of 25 degrees with respect to the under surface 31 which slides on the surface 32 of center plate 22. This positions surface 29 and tool nose 20 at an angle of 45 degrees with respect to the base of tool mount 10. Spacer 27 is slidable laterally along the under surface of center plate 22. Dovetail ribs 40 and 41 on the under surfaces of tool carrier 26 and center plate 22, respectively, mate with slots 43, 44 in the upper surface 32 of center plate 22 and the upper surface 46 of spacer 27, respectively, to guide the sliding movement of the tool carrier and spacer. Tool carrier 26 and spacer 27 are held in adjusted position, by side plates 23, 24 when screw 36 is tightened. The mating surfaces of side plates 23, 24, tool carrier 26 and lateral spacer 27 may be roughened (not shown) to enhance the holding power of the side plates and prevent slippage of the tool carrier 26 and spacer 27 during use.

Pins 48 extend from the sides of tool carrier 26 into slots, 49 on the inner surfaces of side plates 23, 24 to limit movement of the tool carrier. Similarly, pins 51 extend from spacer 27 into slots 52 on the inner surfaces of side plates 23, 24 to limit movement of the spacer.

The tool mount is adjusted for the flooring 12 to be installed by first mounting tool 11 on tool carrier 26. Bolt 36 is then loosened to allow tool carrier 26 and spacer 27 to be adjusted on center plate 22. Tool carrier 26 is first adjusted to position the end 32 of tool nose 20 above the intersection of the top surface of tongue 16 and the face of the strip of tongue and groove flooring 12. Spacer 27 is then adjusted laterally so that the end surface 54 engages the face of the tongue and groove strip below tongue 16. Screw 36 is tightened to hold the tool carrier 26 and spacer 27 in the adjusted positions.

Surface 32*a* at the forward end of center plate 22 is at a 45 degree angle to match tool nose 20 when the tool carrier 26 is moved rearwardly.

A pneumatic driver is typically provided with a firing safety mechanism (not shown) which ensures that the nose of the tool is adjacent a work piece before the tool can be fired. The safety mechanism includes an actuator rod 58 which extends along the tool nose 20 and has an end 59 positioned beyond the end 32 of the tool nose. The tool carrier 26 and spacer 27 are adjusted so that the end 59 of the safety actuator is positioned in the intersection of the top surface of tongue 15 and the adjacent face of the strip of flooring 12 and actuator rod moved in the direction of arrow 60. This allows the tool to be fired. In this situation the end 32 of tool nose 20 is spaced a distance of the order of 1/16"–1/8" from the flooring strip. A fastener when driven is free of the end 32 of the tool nose so that the tool mount 10 and the tool may be moved along the length of the flooring strip 12 without interference from the driven fasteners. Safety actuator rod is preferably seated in a groove 61 in the surface 29 of tool carrier 26. The rod has an offset 62 at the lower end of tool carrier 26 so that the end 59 of the actuator is in the plane of the tool nose 20.

Tool mount 10 may be provided with a handle, as wand 64 which extends from side plate 23 upwardly at an angle of the order of 45 degrees and away from the linear extent of flooring strips 12 at an angle of the order of 45 degrees. A flooring installer moves the mount 10 and tool by pushing handle 64 in the direction of arrow 65. This movement maintains spacer 27 in sliding contact with the face of flooring strip 12. Tool 11 is actuated to drive fasteners at appropriate intervals. An automatic firing mechanism can be incorporated, see Wandel U.S. Pat. No. 2,915,754 or Haley U.S. Pat. No. 4,523,706.

The tool mount may also be used for a tool driving a two-prong decking staple such as those shown in FIGS. 1–4 of Tebo U.S. Pat. No. 5,738,473. In this situation the tool mount is provided with depending side plates which position the mount on a joist supporting the deckboards.

The tool carrier 26 sliding on center plate 22 may be replaced with other vertically adjustable carriers as a ball and screw or a scissors jack, for example.

The tool 11 is typically operated pneumatically. However, the mode of operation is not functionally related to tool mount 10. The tool might be operated electrically.

We claim:

1. A mount for a tool to drive fasteners in installing tongue and groove flooring strips on a subfloor, the fasteners being driven through the strips from above the tongue and into the subfloor, the tool mount comprising:

a base to rest on the subfloor adjacent a flooring strip to be installed, the base having a center plate with an upper surface inclined with respect to the subfloor and an under surface generally parallel with the subfloor, and a pair of side plates, one on either side of the center plate and extending generally at a right angle to the subfloor;

a tool carrier plate slidable on the upper surface of the center plate to adjust the position of a tool carried thereon vertically with respect to the subfloor and the flooring strip;

a lateral spacer plate slidable below the center plate, having an end for engagement with the flooring strip to position the tool mount and the tool carrier on the tool carrier plate laterally with respect to the flooring strip; and a fastener securing the side plates to the center plate and clamping the tool carrier plate and the spacer plate in their adjusted positions, to locate the tool carrier adjacent the flooring strip and above the tongue to drive a fastener through the flooring strip and into the subfloor.

2. The tool mount of claim 1 in which the tool carrier plate has an under surface slidable on the upper surface of the center plate and an upper surface at an acute angle with respect to the under surface thereof, the tool being carried on the upper surface of the tool carrier plate.

3. The tool mount of claim 2 wherein the acute angle between the surfaces of the tool carrier plate plus the angle of inclination between the surfaces of the center plate equal substantially 45°.

4. The tool mount of claim 2 wherein the angle between the surfaces of the tool carrier plate is of the order of 25° and the angle of inclination between the surfaces of the center plate is of the order of 20 °.

5. The tool mount of claim 1 in which the side plates having mating surfaces with the edges of the tool carrier and lateral space plates which mating surfaces and plate edges are rough to enhance clamping of the tool carrier and lateral spacer plates by the side plates.

6. The tool mount of claim 1 with guides between the center plate and the tool carrier plate and lateral spacer plate, respectively.

7. The tool mount of claim 6 in which each guide comprises a dove tail rib and a mating slot on adjacent surfaces.

8. The tool mount of claim 1 with stops limiting movement of the tool carrier plate and the lateral spacer plate, respectively, with respect to said base.

9. The tool mount of claim 8 in which each of said stops comprises a pin received in a mating slot.

10. A mount for a tool to drive fasteners in installing flooring strips on a subfloor, comprising:

a base to rest on the subfloor for movement adjacent a flooring strip having an edge to be installed and to locate a tool carrier thereon adjacent the flooring strip to be installed, to drive fasteners through the flooring strip and into the subfloor; and a wand extending upwardly from the base and angled laterally away from the flooring strip, to be pushed by the operator to move the tool mount against and along the flooring strip; said wand lying in a plane transverse to a vertical plane containing said edge.

11. The tool mount of claim 10 in which said wand extends upwardly at an angle of the order of 45° and away from the flooring strip at an angle of the order of 45°.

* * * * *